US006516507B2

(12) United States Patent
Noel et al.

(10) Patent No.: US 6,516,507 B2
(45) Date of Patent: Feb. 11, 2003

(54) METHOD OF MAKING A METAL DRAWER HEAD

(75) Inventors: David P. Noel, Muskegon, MI (US); Stephen A. Rockwell, Grand Rapids, MI (US); Thomas E. Bruce, Wayland, MI (US); Bernard R. Lavas, Muskegon, MI (US)

(73) Assignee: Knoll, Inc., East Greenville, PA (US)

( * ) Notice: Subject to any disclaimer, the term of this patent is extended or adjusted under 35 U.S.C. 154(b) by 46 days.

(21) Appl. No.: 09/881,866

(22) Filed: Jun. 15, 2001

(65) Prior Publication Data

US 2002/0189070 A1 Dec. 19, 2002

(51) Int. Cl.[7] ..... B23P 11/00
(52) U.S. Cl. ..... 29/505; 72/379.2; 312/348.4
(58) Field of Search ..... 29/897, 418, 430, 29/505, 557; 72/379.2, 404; 312/348.4, 332.1, 257.1, 258, 244

(56) References Cited

U.S. PATENT DOCUMENTS

| | | | | |
|---|---|---|---|---|
| 1,136,071 A | | 4/1915 | Weiss | |
| 1,172,189 A | | 2/1916 | Bauer | |
| 2,539,963 A | * | 1/1951 | Moberg | 312/334.7 |
| 3,024,075 A | | 3/1962 | Howe | |
| 3,179,480 A | | 4/1965 | Brinker | |
| 3,542,447 A | | 11/1970 | Himelreich | |
| 3,752,553 A | | 8/1973 | Bildahl et al. | |
| 3,933,402 A | | 1/1976 | Peterson | |
| 4,090,757 A | | 5/1978 | Frey et al. | |
| 4,440,461 A | * | 4/1984 | Powell et al. | 312/334.8 |
| 4,861,123 A | * | 8/1989 | Russell | 312/334.7 |
| 4,902,080 A | | 2/1990 | Berger | |
| 5,161,870 A | | 11/1992 | Mason et al. | |

* cited by examiner

*Primary Examiner*—Gregory M. Vidovich
*Assistant Examiner*—Jermie E. Cozart
(74) *Attorney, Agent, or Firm*—Buchanan Ingersoll, P.C.

(57) ABSTRACT

A method for making a metal drawer head wherein the drawer head can be formed as a unitary part in a multiple stage process without the need for human manipulation of the part during any stage of the forming process. A rotary forming process can preferably be used to form the flanges on the drawer head.

6 Claims, 8 Drawing Sheets

METHOD OF MAKING A METAL DRAWER HEAD

BACKGROUND

Figure 1:
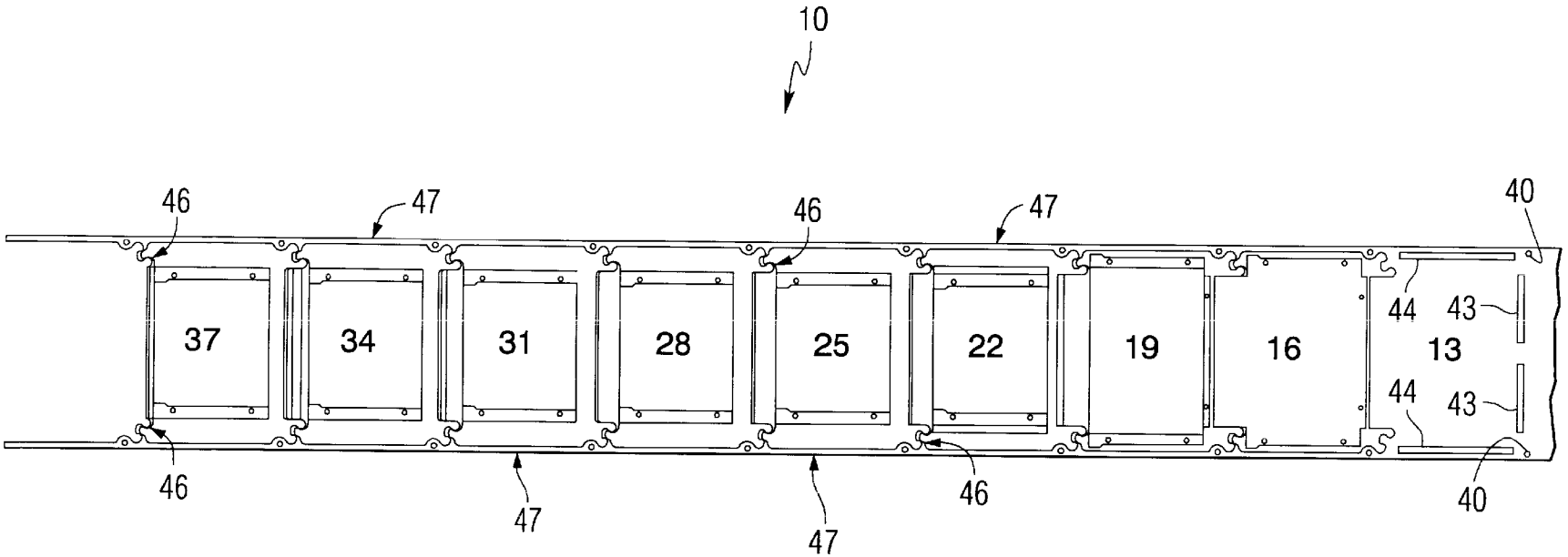

This invention relates generally to a metal drawer head, i.e., the front part of a metal drawer which is commonly made separate from and later attached to the sides of the drawer body, and more particularly, to a method for making a metal drawer head using a single progressive die wherein the entire drawer head is formed, through various stages without removal from the die, from flat stock into a final part ready to be attached to the sides of the drawer body.

The making of metal drawer heads is well known in the prior art. Conventional methods of making a metal drawer head involve separately forming two parts which are then connected together, typically welded, to form the final drawer head which is attached to the drawer body. Additionally, these methods utilize flanging and/or roll forming processes to bend the metal into the desired shape. Moreover, multiple operations carried out in the making of the prior art drawer head require partially finished portions of the drawer head to be manipulated by a human operator during the forming process.

One prior art method of making a metal drawer head involves separately forming a drawer front portion and a handle portion and then connecting them together before the completed drawer head can be attached to the sides of a drawer body. The drawer front portion is formed in multiple stages, including an initial stage where stock material is trimmed to a certain shape configured to facilitate subsequent forming operations, such as forming flanges. The holes are pierced to create connection members for attachment to the front of the drawer body. Subsequent flanging stages complete the forming of the drawer front portion. The handle portion is roll formed in a separate multiple stage process, which includes trimming stock material, forming notches, and piercing holes. Subsequent stages include roll-form shaping of the handle portion, and secondary piercing and forming operations. After the two separate drawer front and handle portions are finished, they are spot welded together and are thereafter attached to the front of the drawer body.

As can be understood, it is thus desirable to provide a method wherein the entire metal drawer head can be formed from flat stock to finished part in a single process requiring no human manipulation. Such a method can greatly improve efficiency and reduce the cost of making the metal drawer head.

SUMMARY

The invention provides a method for making a metal drawer head wherein the drawer head can be formed as a unitary part, in a presently preferred embodiment using a multiple stage progressive die. Metal stock material can be formed into a unitary metal drawer head having the final desired shape without having to remove the part from the die at any time and without the need for any human manipulation during the forming process. Moreover, a rotary forming process can be used to form the flanges on the drawer head, unlike conventional methods which use flanging or roll-forming processes. A preferred method can utilize a multiple stage process which carries out the entire forming process from flat stock to finished part. During the process, flat stock is first trimmed into a configuration designated to facilitate subsequent flanging processes. Other processing can include creating connection elements such as holes and tabs, for attaching the finished drawer head to the sides of a drawer body. Additionally, the flanges can be rotary formed at each side of the part, including the formation of a handle. The edge of the handle can be hemmed under to form a smooth front edge, the corners of which can also be trimmed into rounded corners. Finally, waste material which was utilized to process the drawer head through the different stages can be trimmed off and discarded, leaving the finished part.

Accordingly, stock material can be formed into a finished metal drawer head in one continuous process wherein all of the forming procedures for the metal drawer head can be performed without the need for human manipulation of the part at any stage in the process.

Other details, objects, and advantages of the invention will become apparent from the following detailed description and the accompanying drawings figures of certain embodiments thereof.

BRIEF DESCRIPTION OF THE DRAWING FIGURES

Figure 2B:
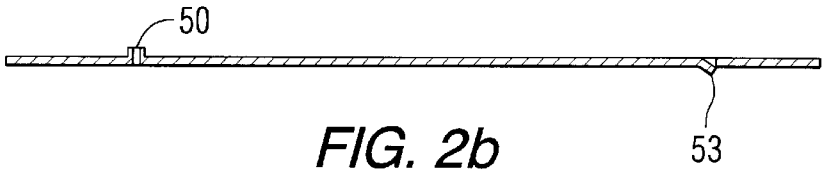
Figure 2A:
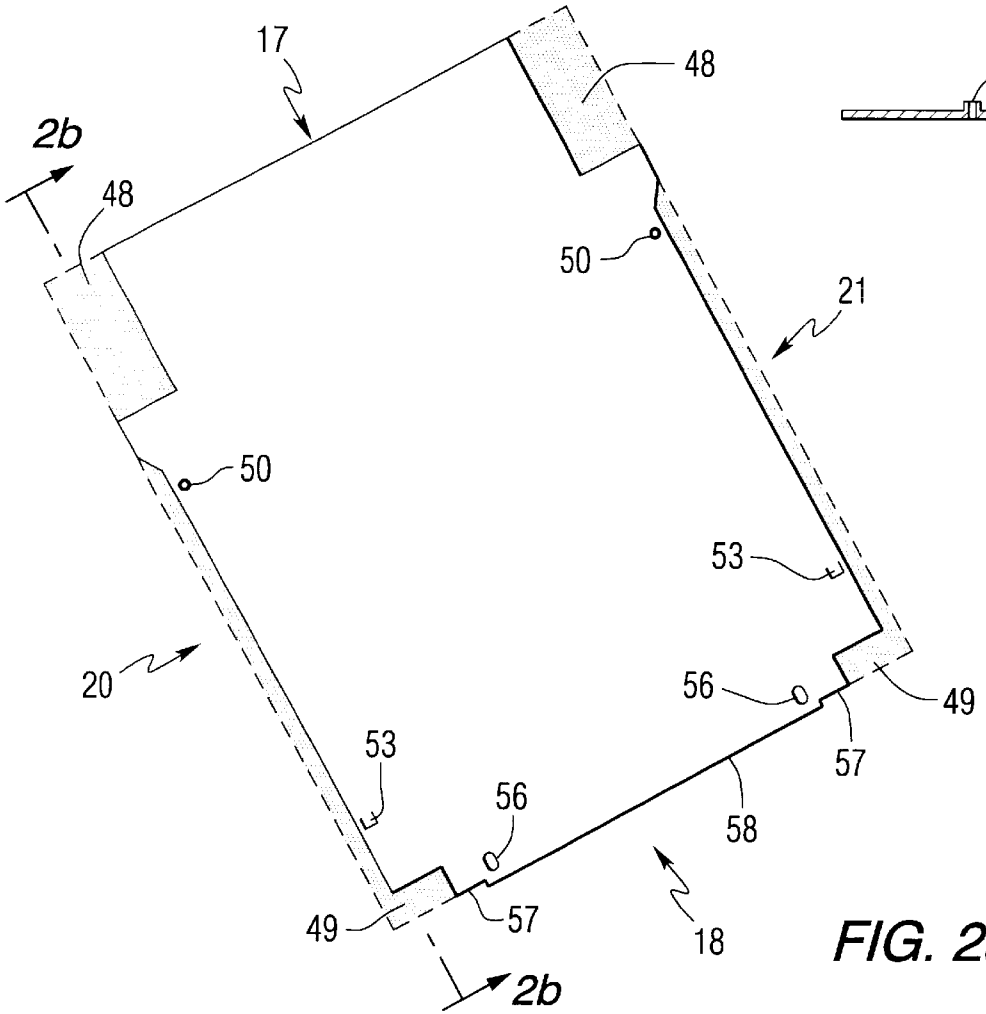

A more complete understanding of the invention can be obtained by considering the following detailed description in conjunction with the accompanying drawings, in which:

FIG. 1 is a top plan view of a preferred embodiment of the invention, illustrating the nine stages of the method;

FIG. 2*a* is an isometric view showing the shape of the drawer head at the second stage of the method;

FIG. 2*b* is a cross section view take through the line 2*b*—2*b;*

Figure 3B:
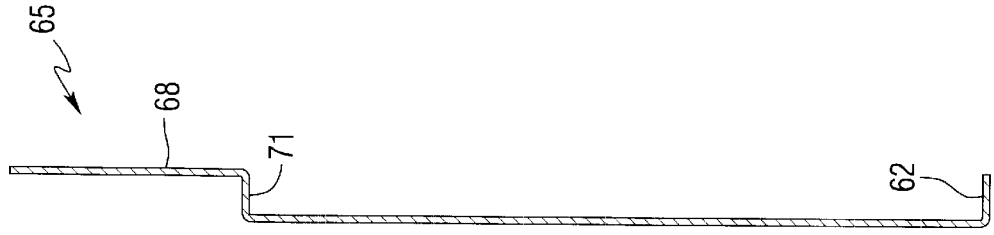
Figure 3A:
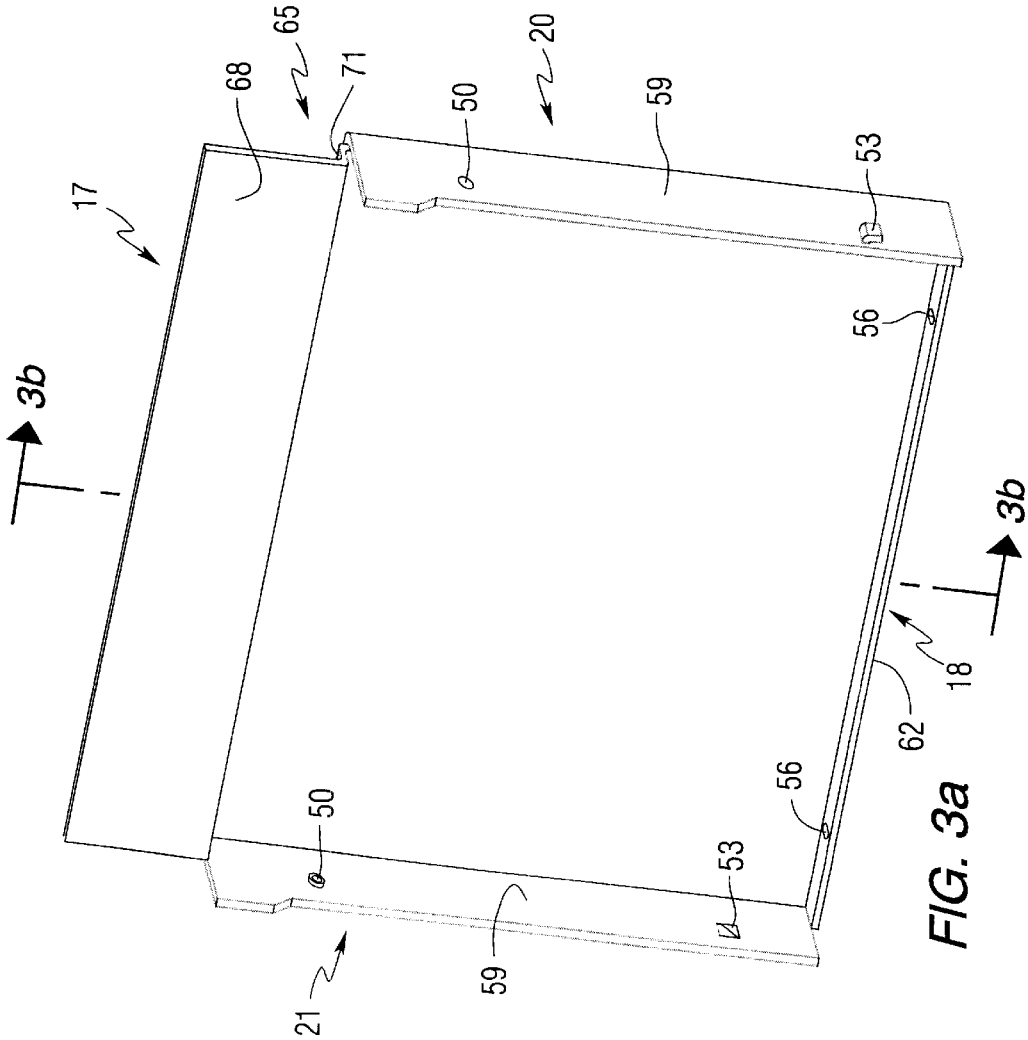

FIG. 3*a* is an isometric view showing the shape of the drawer head at the third stage of the method;

FIG. 3*b* is a cross section view take through the line 3*a*—2*b;*

Figure 4B:
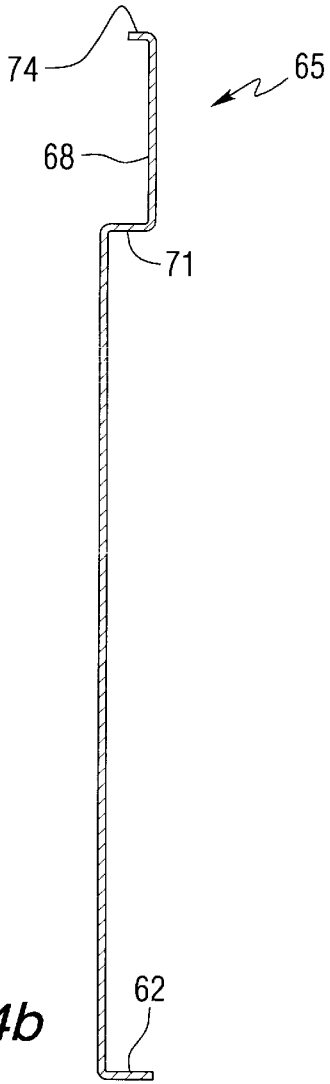
Figure 4A:
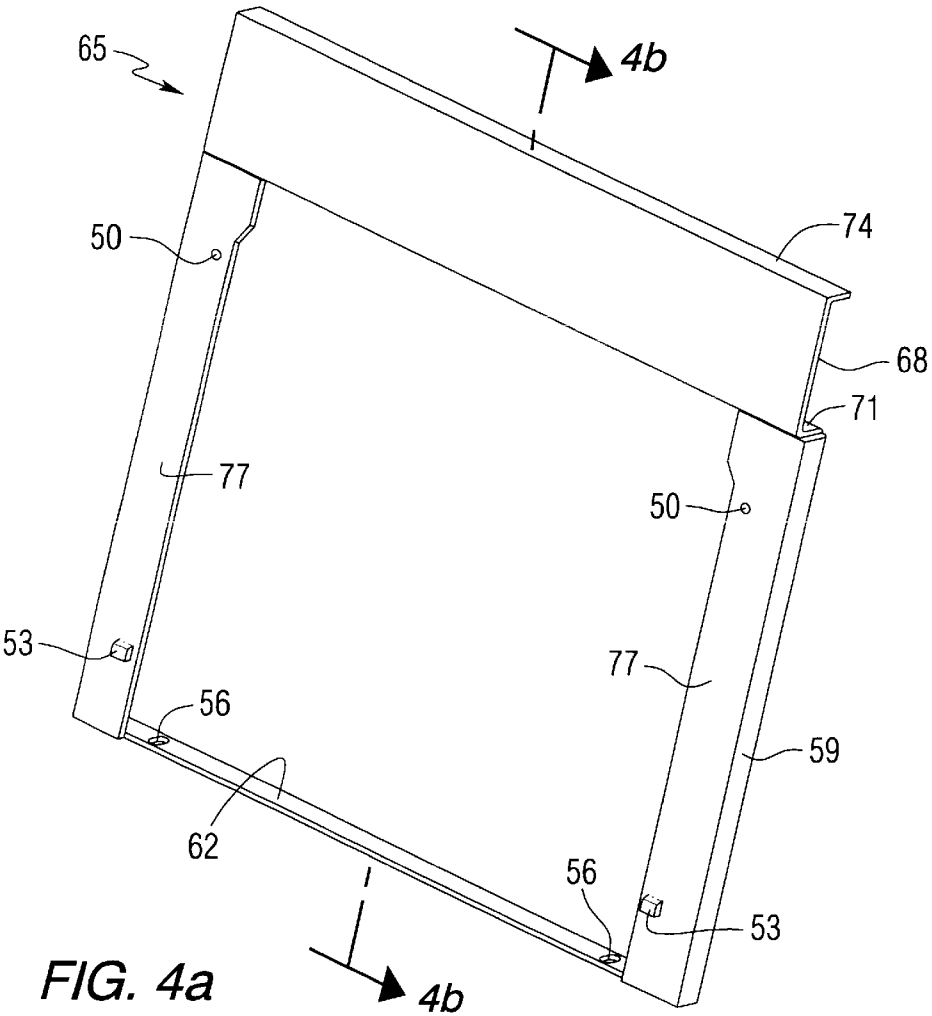

FIG. 4*a* is an isometric view showing the shape of the drawer head at the fourth stage of the method;

FIG. 4*b* is a cross section view take through the line 4*b*—4*b;*

Figure 5B:
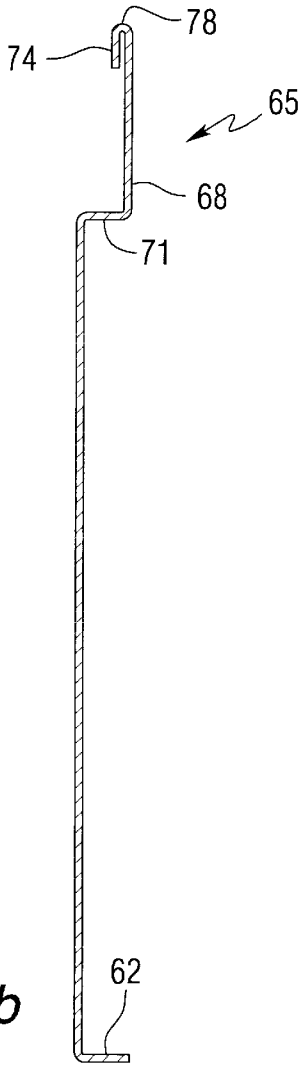
Figure 5A:
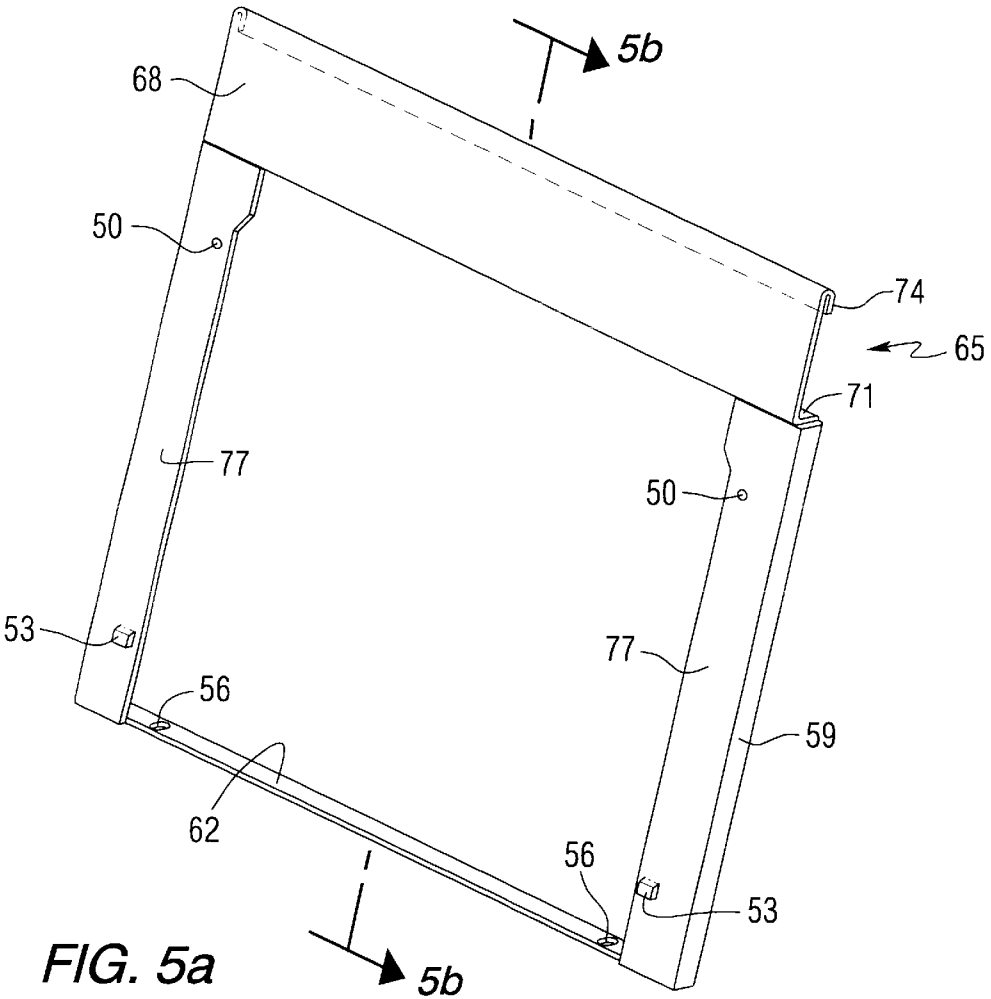

FIG. 5*a* is an isometric view showing the shape of the drawer head at the fifth stage of the method;

FIG. 5*b* is a cross section view take through the line 5*b*—5*b;*

Figure 6:
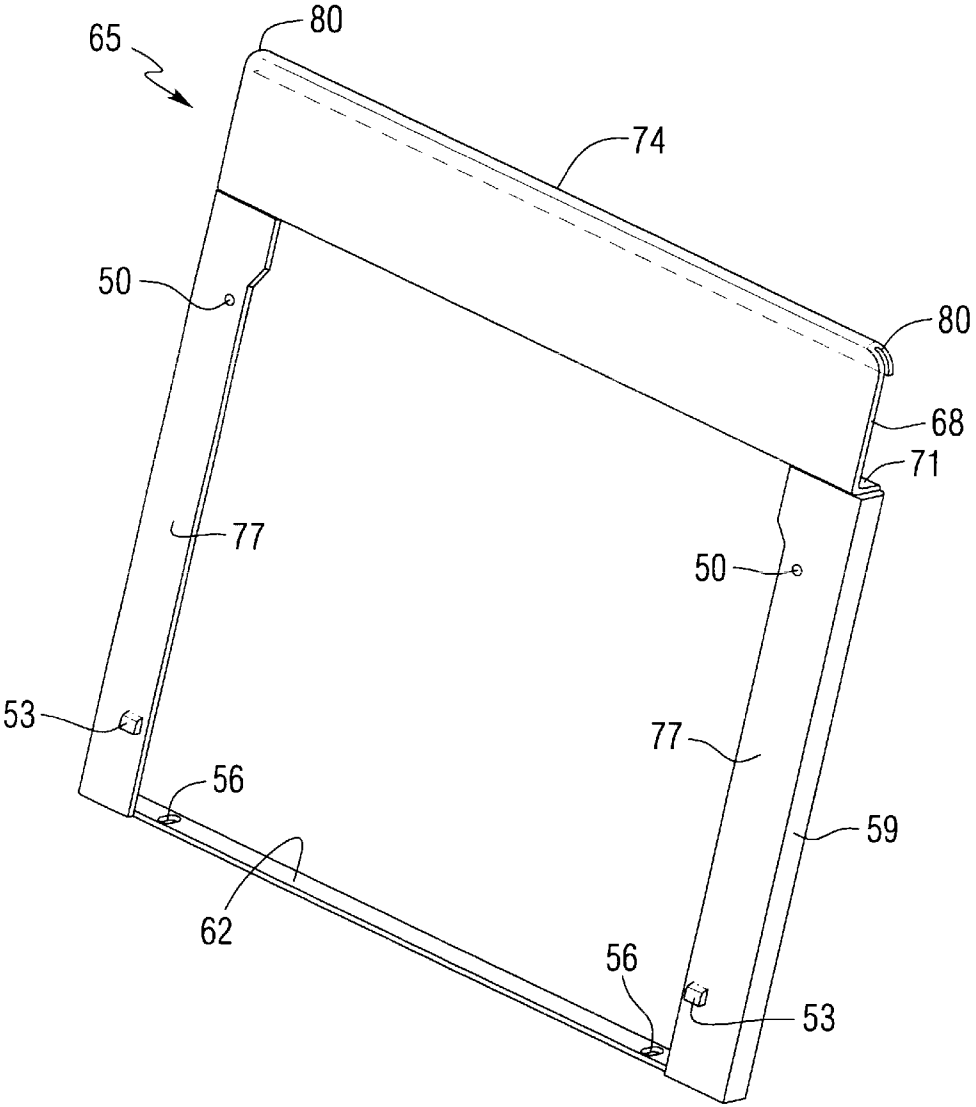
Figure 7B:
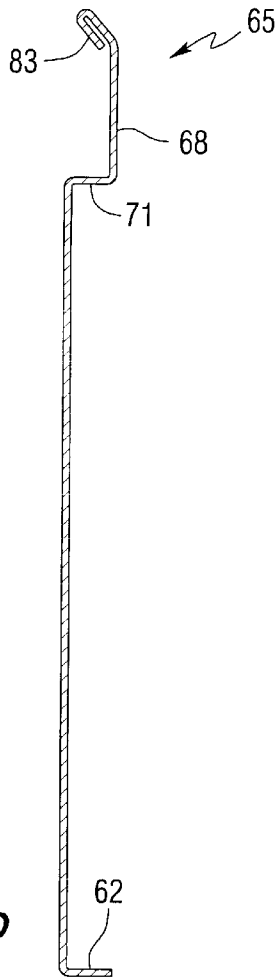
Figure 7A:
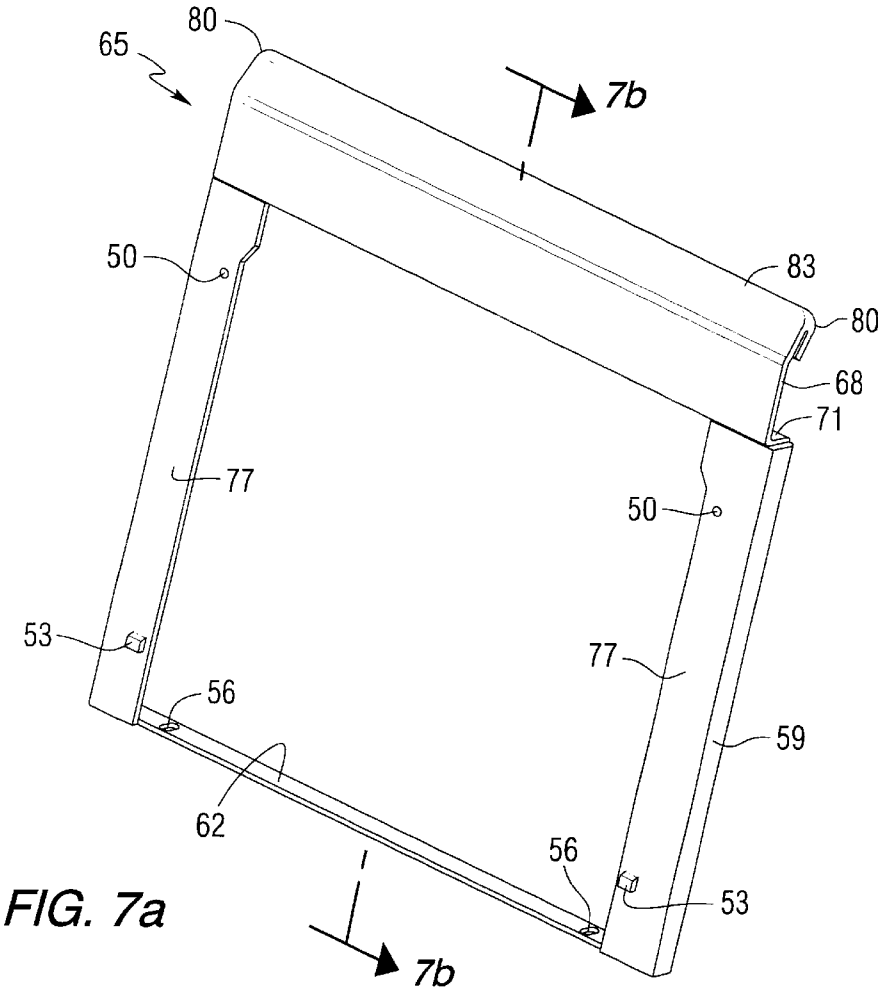

FIG. 6 is an isometric view showing the shape of the drawer head at the sixth stage of the method;

FIG. 7*a* is an isometric view showing the shape of the drawer head at the seventh stage of the method;

FIG. 7*b* is a cross section view take through the line 7*b*—7*b;*

Figure 8B:
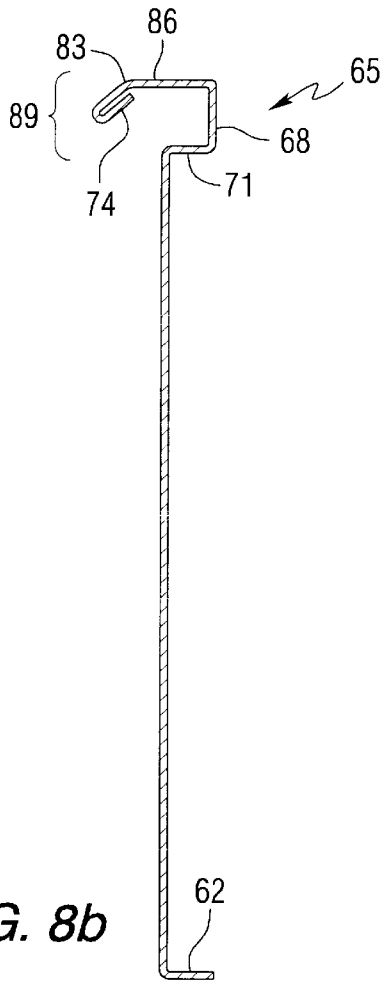
Figure 8A:
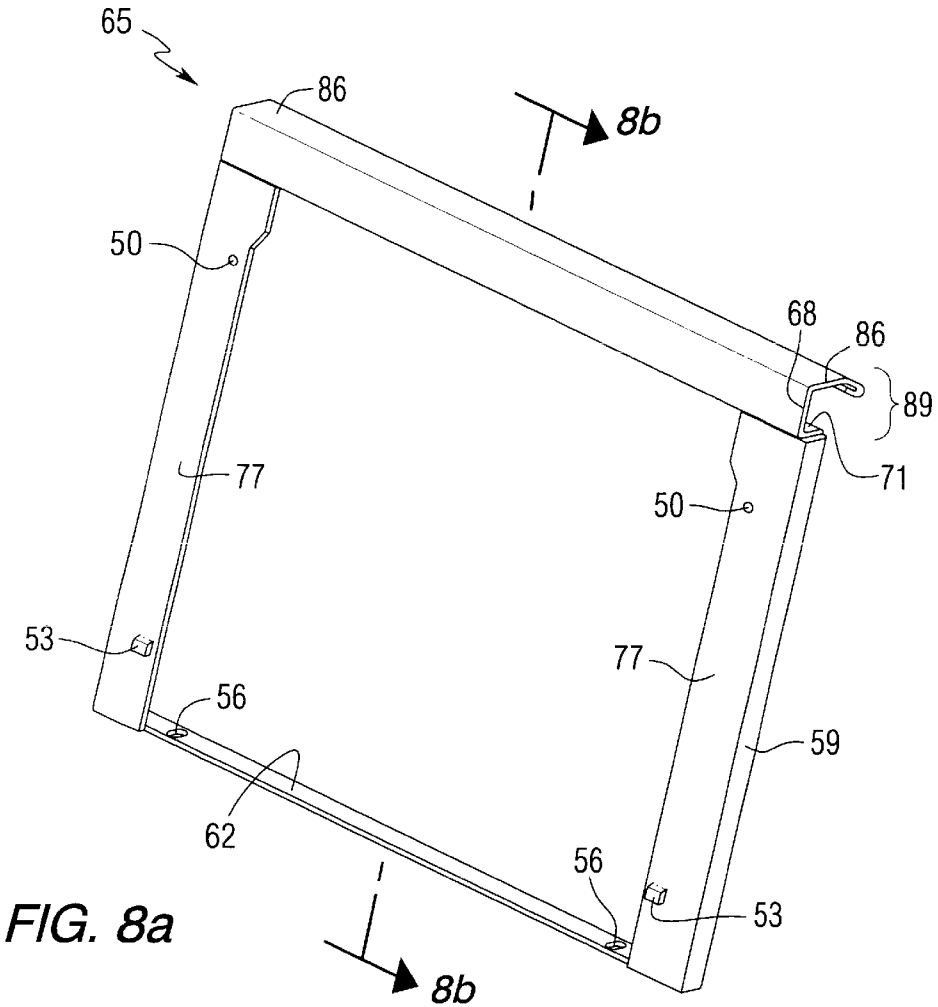

FIG. 8*a* is an isometric view showing the shape of the drawer head at the eighth stage of the method; and FIG. 8*b* is a cross section view take through the line 8*b*—8*b;*

DETAILED DESCRIPTION OF CERTAIN EMBODIMENTS

Referring now to the drawing figures wherein like reference numbers refer to similar parts throughout the several views, a presently preferred method for forming a metal drawer head in a multiple stage progressive die 10 is shown in FIG. 1, wherein the die 10 is shown having nine stages which represent a preferred embodiment utilizing nine steps to form a finished metal drawer head from flat stock in one continuous forming process.

FIGS. 2*a* through 8*a* are isometric views which illustrate the shape of the part after it has been processed at the second 16 through eighth 37 stages of the nine stage die 10. An isometric view of the part after processing at the first stage 13 is not illustrated since it would simply show the flat stock, as can generally be seen by looking at the first stage 13 in FIG. 1. The shape of the part after processing at the first stage 13 is a flat section of material which has not yet been processed in any way related to the desired shape of the drawer head. Although a slight amount of processing is performed in the first stage 13, e.g., some pilot holes 40 and slots 43, 44 are cut, this processing is simply for use in forming the drawer head in later stages, and is not directly related to processes which directly affect the desired final shape of the metal drawer head. Similarly, in the ninth stage 37 of the process, an isometric view is not provided because the metal drawer head looks the same as it is illustrated in the eighth stage 34 except that waste material 47 (which, for clarity, is not shown in any of the isometric views) is trimmed off the part as it is delivered from the ninth stage 37 of the die 10. The waste material 47 can be seen in FIG. 1, which shows all nine stages 13–37 of a presently preferred embodiment of the multiple stage die 10. In particular, the waste material 47 consists of thin strips of metal along both the upper and lower edges of the part at each of the stages in the die, including the ribbon shaped strips 46 of material connecting to the forward corners of the part at each stage 13–37 of the die 10.

Referring now to FIG. 2*a,* there is shown an isometric view of the shape of the metal drawer head subsequent to processing in the second stage 16. As can be seen, the metal stock has been trimmed into a certain shape, having top 17, bottom 18, and opposite sides 20, 21. The trimming is performed to configure the stock material into a shape designed to facilitate later formation of the flanges and handle of the drawer head. For example, portions of material, such as indicated by reference numbers 48 and 49, can be removed, mostly at the corners, to facilitate subsequent formation of flanges at each side of the part. Generally, this material has been trimmed off to eliminate any interference between the edges of the flanges when they are formed, and to permit the surfaces of the flanges to be generally flush. Additionally, shallow notches 57 can been trimmed off at left and right corners of lower edge 58 such that when flanges are later formed they will be generally flush with the edge 58 of the drawer head, as explained in more detail below in connection with the description of the fourth stage 22 of processing. Additionally, holes 50 can be extruded and tabs 53 can be lance formed. The holes 50 and tabs 53 can be utilized to attached the metal drawer head to the drawer body (not shown). Holes 56 for hanging the part on a paint rack (not shown) can also be pierced during processing at the second stage 16.

FIG. 3*a* illustrates the shape of the metal drawer head after it has been processed in the third stage 19 of the die 10. In this stage 19 it can be seen that a first flange 59 has been formed in each side 20, 21 of the drawer head, along with a flange 62 in the bottom 18, and an L-shaped flange 65 in the top 17 of the metal drawer head. The L-shaped flange 65 will eventually be formed into a handle for the drawer. As can be seen more clearly in the cross section view in FIG. 3*b,* the L-shaped flange 65 can have a longer side 68 and a shorter side 71.

Referring now to FIGS. 4*a* and 4*b,* after processing in the fourth stage 22, an additional flange 74 can be formed in the longer side 68 of the L-shaped flange 65. Additionally, a second flange can be formed in the side flange 59 by bending a portion of the side flange 59 in toward an interior side of the metal drawer head. As shown, the flanges 59 and 77 at either side of the drawer, form C-shaped channels which open toward each other. As referred to in connection with FIG. 2*a,* the flanges 77 can be received in shallow notches 57 such that the C-shaped channel can set generally flush with the edge of the flange 62 in the bottom of the part. It also can be seen that the connection members, such as the holes 50 and tabs 53, are positioned such that when flanges 77 are formed to create the C-shaped channels, the connection members 50, 53 are positioned in an externally accessible manner for attaching the drawer head to the sides of a drawer body.

Referring now to FIGS. 5*a* and 5*b,* after processing at the fifth stage 25 in the die 10, the additional flange 74 at the edge of the longer side 68 of the L-shaped flange 65 has been folded entirely under and crimped against the longer side 68. This process is commonly known as "hemming under," and forms a double thickness of material at the edge of the flange, and also provides a smooth, rounded edge 78 for the handle of the metal drawer head which will be subsequently formed from the L-shaped flange 65.

As shown in FIG. 6, the only operation performed in the sixth stage 28 is trimming the corners of the hemmed area in order to provide rounded corners 80 for what will later be formed into the handle for the metal drawer head.

The shape of the handle is formed in stages 31 and 34, referring to FIGS. 7*a* through 8*b*. As shown, the operation performed at the seventh stage 31 is to curve down the edge of the longer side 68 of the L-shaped flange 65 to form a curved portion 83. In the eighth stage 34 an additional flange 86 is formed by bending down a portion of the longer side 68 of the L-shaped flange 65 in order to provide another C-shaped channel, this one opening toward the front of the metal drawer head to form a handle 89.

As explained previously, in the ninth stage 37 the only additional processing that occurs is to trim off the waste material 46, 47 which was used to process the drawer through the different stages 13–37 of the die 10. Thus, as described above, the entire metal drawer head can be completely processed through multiple stages from flat stock to finished part, without being removed from the die 10 and without any need for any type of human manipulation during the process. Additionally, the drawer head is formed in one piece and thus requires no additional processing after it is produced, in contrast to conventional two piece drawer heads which must be connected together prior to attachment to the front of a drawer body (not shown).

Another unconventional feature of the method according to the invention is that all of the bending of the flanges can be carried out by a rotary forming process rather than the typical flanging or roll forming processes commonly employed. Rotary forming, roll forming and flanging processes are all well known by those of skill in the art. However, a method according to the invention, unlike prior art methods which use roll forming or flanging processes, incorporates a rotary forming process to perform all of the bending of the material.

Although certain embodiments of the invention have been described in detail, it will be appreciated by those skilled in the art that various modifications to those details could be developed in light of the overall teaching of the disclosure. Accordingly, the particular embodiments disclosed herein are intended to be illustrative only and not limiting to the scope of the invention which should be awarded the full breadth of the following claims and any and all embodiments thereof.

What is claimed is:

1. A method for making a unitary metal drawer head in a continuous process requiring no human manipulation stock of material at any stage of the process, said method comprising the steps of:

a. feeding stock material to a first processing stage, said stock material having a top portion, bottom portion, and two side portions;

b. trimming said stock material into a shape configured to facilitate the formation of flanges during subsequent processing;

c. forming connection elements in each of said two side portions for attaching the drawer head to a drawer;

d. forming a first flange in each of said at least two side portions;

e. forming a second flange in said bottom portion;

e. forming a handle in said top portion; and f. delivering the drawer head from a last stage of processing.

2. The method of claim 1 wherein said connection elements comprise at least one of holes and tabs.

3. The method of claim 1 wherein said forming said first and second flanges and said handle further comprises rotary forming.

4. The method of claim 1 wherein forming said first flange further comprises the steps of:

a. forming said first flange into a C-shaped channel at each of said two side portions, each said C-shaped channel opening towards the other; and b. trimming shallow notches in an edge of said second flange in said bottom portion adjacent each of said two side portions, an outer side of said C-shaped channel at each of said two side portions being received in said shallow notches, said shallow notches having a depth such that said outer side of each C-shaped channel sets flush with an untrimmed portion of said edge in said second flange.

5. The method of claim 1 wherein forming said handle further comprises a second C-shaped channel in said top portion, said second C-shaped channel opening towards a front face of the drawer head.

6. The method of claim 5 wherein forming said handle further comprises the steps of:

a. hemming under an edge of a top leg of said C-shaped channel;

b. trimming said hemmed under edge to form rounded corners; and c. forming a curve in said top leg, said curve formed downwardly toward said front face.

* * * * *